US008382510B2

(12) United States Patent
Lee et al.

(10) Patent No.: US 8,382,510 B2
(45) Date of Patent: Feb. 26, 2013

(54) ELECTRICAL CONNECTOR ASSEMBLY

(75) Inventors: Gang Lee, Shanghai (CN); Chih-Hsieh Chang, Taipei (TW); Huibin Li, Shanghai (CN)

(73) Assignees: Tyco Electronics (Shanghai) Co. Ltd., Shanghai (CN); Tyco Electronics Holdings (Bermuda) No. 7 Limited, Pembroke (BM)

( * ) Notice: Subject to any disclaimer, the term of this patent is extended or adjusted under 35 U.S.C. 154(b) by 0 days.

(21) Appl. No.: 13/246,378

(22) Filed: Sep. 27, 2011

(65) Prior Publication Data

US 2012/0077370 A1 Mar. 29, 2012

(30) Foreign Application Priority Data

Sep. 29, 2010 (CN) ..... 2010 2 0556813 U

(51) Int. Cl.
*H01R 3/00* (2006.01)

(52) U.S. Cl. ..... 439/490; 439/79

(58) Field of Classification Search ..... 439/79, 439/488–491, 607.4
See application file for complete search history.

(56) References Cited

U.S. PATENT DOCUMENTS

| | | | | |
|---|---|---|---|---|
| 5,876,239 | A * | 3/1999 | Morin et al. | 439/490 |
| 6,095,851 | A * | 8/2000 | Laity et al. | 439/490 |
| 7,635,273 | B2 * | 12/2009 | Buzil et al. | 439/214 |
| 7,654,858 | B2 * | 2/2010 | Geiger | 439/490 |
| 7,686,643 | B2 * | 3/2010 | Pepe et al. | 439/490 |

* cited by examiner

*Primary Examiner* — Khiem Nguyen
(74) *Attorney, Agent, or Firm* — Barley Snyder

(57) ABSTRACT

An electrical connector assembly for an electronic device. The electrical connector assembly having an electrical connector and a signal indicator. The electrical connector having at least two communication interfaces utilizing different communication standards. The signal indicator is secured along one side of the electrical connector, wherein the signal indicator emits different colors of light corresponding to a function of one of the at least two communication interfaces.

19 Claims, 5 Drawing Sheets

ELECTRICAL CONNECTOR ASSEMBLY

CROSS-REFERENCE TO RELATED APPLICATION

This application claims the benefit and priority of Chinese Patent Application No. 201020556813.6 filed on Sep. 29, 2010 before the State Intellectual Property Office of China, the disclosure of which is incorporated herein by reference.

FIELD OF THE INVENTION

The present invention relates to an electrical connector assembly and in particular to a electrical connector assembly capable of indicating different operation states of the communication interfaces.

BACKGROUND

In order to transmit data effectively between a computer and periphery equipments thereof, electrical connectors using different communication standards have been developed. These electrical connectors comprise the USB (Universal Serial Bus) interface and the eSATA (external Serial Advanced Technology Attachment) interface, etc, wherein the USB interfaces may further include the USB2.0 interface and the USB3.0 interface.

With the development of the technology, the computer is becoming more compact to save space, thus, an electrical connector integrated with both the USB 2.0 interface and the USB 3.0 interface, and even further with the eSATA interface, is proposed. For instance, in an electrical connector integrated with both the USB2.0 interface and the USB3.0 interface, the conductive terminals according with the USB2.0 communication standard and the conductive terminals according with the USB3.0 communication standard are provided respectively at two surfaces of an insulation body.

Such electrical connectors are used in an electronic device, such as a computer, a camera, a video camera and e-book and the like, and are electrically connected with a periphery apparatus via a further corresponding electrical connector, so that the data communication between the electronic device and the periphery apparatus thereof is performed.

However, in the above known electrical connector, the conductive terminals according with the USB2.0 communication standard and the conductive terminals according with the USB3.0 communication standard are respectively connected with data processing circuits in the electronic device through independent signal transmission circuits. Therefore, larger space inside the electronic apparatus is still occupied. Further, in use, the above known electrical connector cannot indicate which one of the signal transmission circuits for the USB2.0 interface and the signal transmission circuit for the USB3.0 interface is in an operation state.

SUMMARY

The present invention has been made to overcome or alleviate at least one aspect of the above mentioned disadvantages.

The present invention is directed to provide a electrical connector assembly, wherein the operation states of the communication interfaces of the electrical connector assembly can be indicated.

An electrical connector assembly for an electronic device. The electrical connector assembly having an electrical connector and a signal indicator. The electrical connector having at least two communication interfaces utilizing different communication standards. The signal indicator is secured along one side of the electrical connector, wherein the signal indicator emits different colors of light corresponding to a function of one of the at least two communication interfaces.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF PREFERRED EMBODIMENTS

Figure 1:
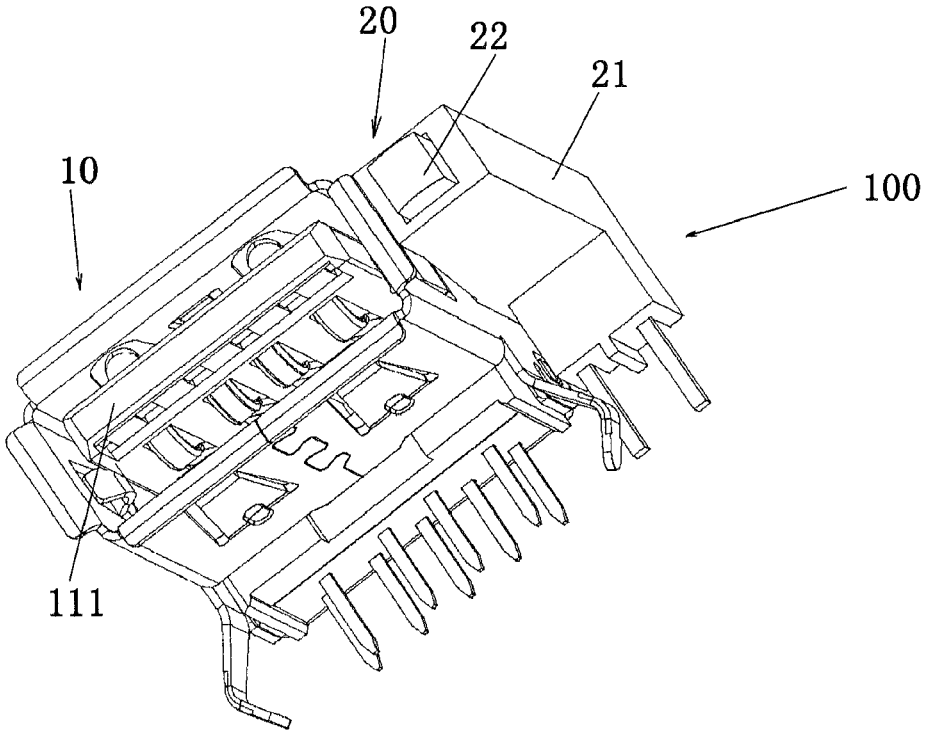
FIG. 1 is a perspective view of an electrical connector assembly according to the invention.
Figure 2:
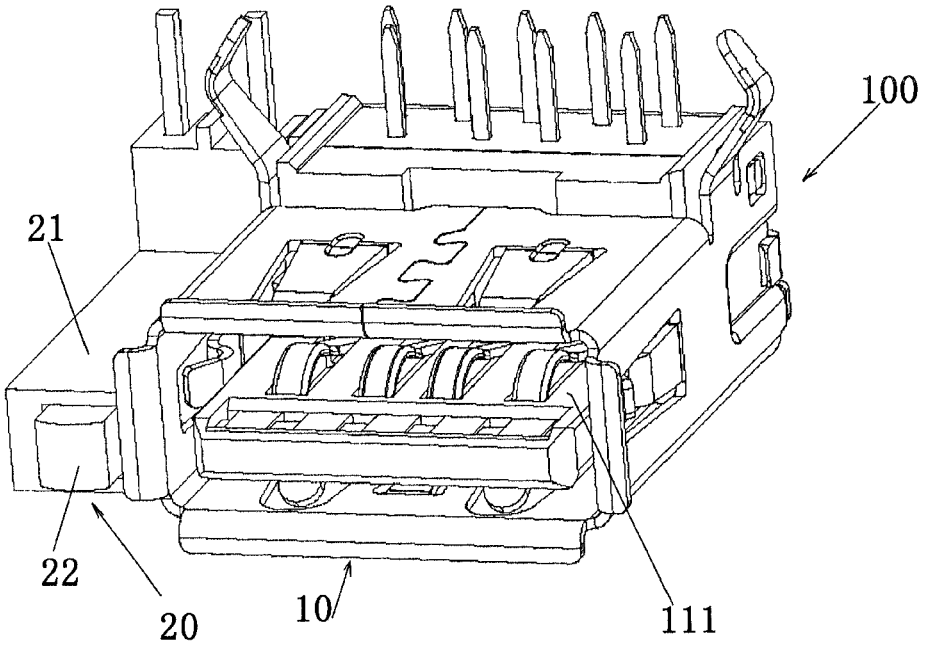
FIG. 2 is another perspective view of the electrical connector assembly according to the invention.

The embodiments of the invention will be described hereinafter in detail with reference to the attached drawings, wherein the like reference numerals refer to the like elements. The invention may, however, be embodied in many different forms and should not be construed as being limited to the embodiments set forth herein.

Referring to FIGS. 1-9, an electrical connector assembly 100 according to an embodiment of the present invention is, for example, a socket electrical connector assembly mounted to an electronic device such as a computer, a camera, a video camera and the like, and is adapted to be electrically connected with plug electrical connectors of periphery apparatuses of the computer such as a USB memory, a display, a printer, and an electronic camera.

The electrical connector assembly 100 includes an electrical connector 10 mounted to an electronic device (not shown) and including at least two communication interfaces respectively according with different communication standards, wherein the at least two communication interfaces are adapted to electrically connect with other corresponding electrical connectors of the periphery apparatuses of the electronic device; and a signal indicator 20 mounted at one side of the electrical connector 10, wherein the signal indicator 20 indicates respectively operation states of the at least two communication interfaces by emitting light of different colors according to signals from the electronic apparatus, for instance, the signal indicator 20 indicates the specific communication standards under which the communication interface is currently operated.

In a shown embodiment of the present invention, the at least two communication interfaces include at least two of a USB2.0 interface, a USB3.0 interface and an eSATA interface, for example, the USB2.0 interface and the USB3.0 interface. In addition, it is known in the art that (refer to FIG. 3), the USB2.0 interface has first conductive terminals 31 according with the USB2.0 standard and each including a first connection portion 311; the USB3.0 interface has second conductive terminals 32 according with the USB3.0 standard and each including a second connection portion 321; and the eSATA interface has third conductive terminals (not shown) according with the eSATA standard and each including a third connection portion.

The above interfaces may be electrically connected respectively with other interfaces, according with the USB2.0 standard, the USB3.0 standard or the eSATA standard, of a further electrical connector of the periphery apparatus.

In a further embodiment according to the invention, the electrical connector 10 includes a second housing 12 made of electromagnetic shielding material, such as a metal sheet; and an insulation body 11 made of, for example, polyurethane material.

Figure 3:
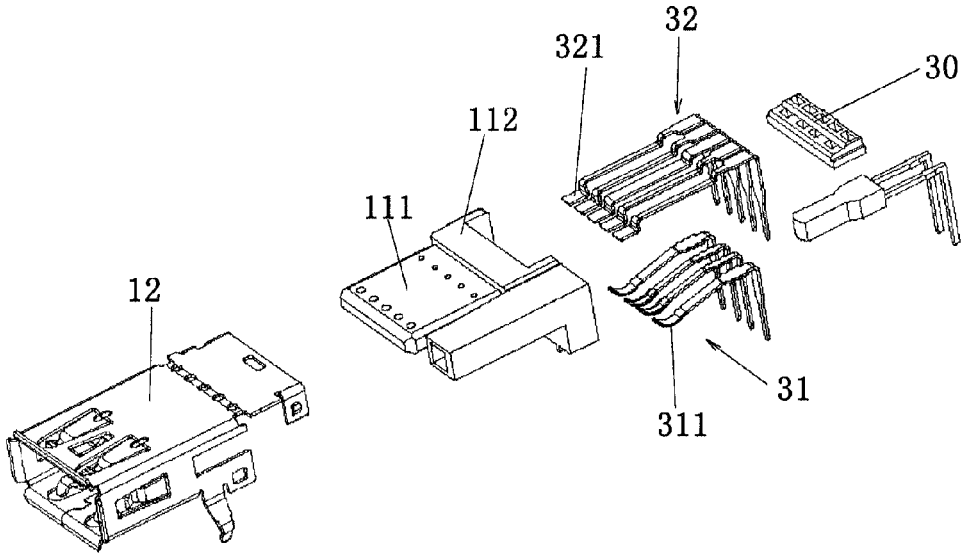
FIG. 3 in an exploded perspective view of the electrical connector assembly of FIG. 1.
Figure 4:
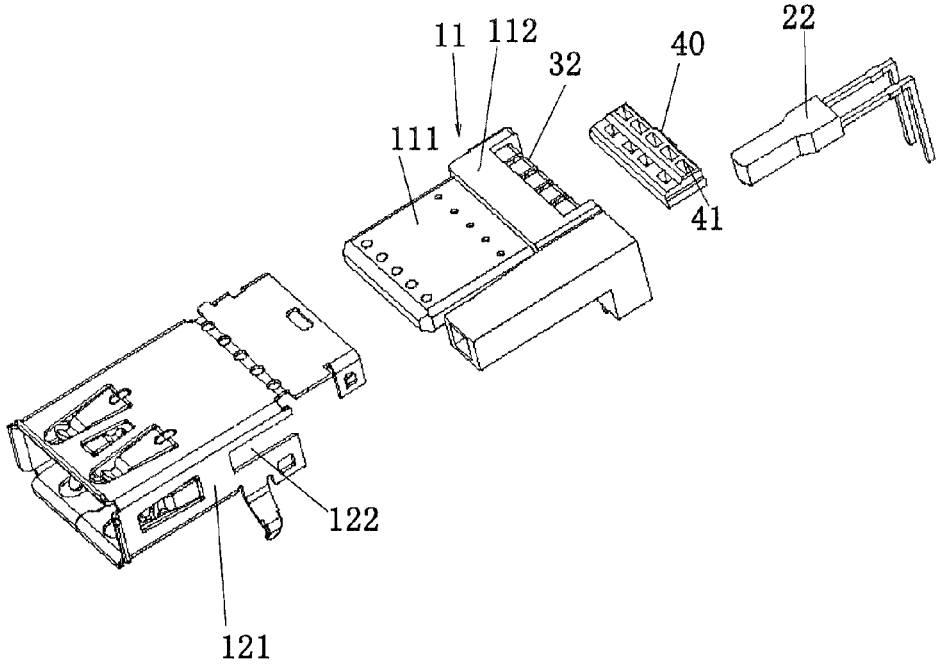
FIG. 4 in another exploded perspective view of the electrical connector assembly of FIG. 1.
Figure 5:
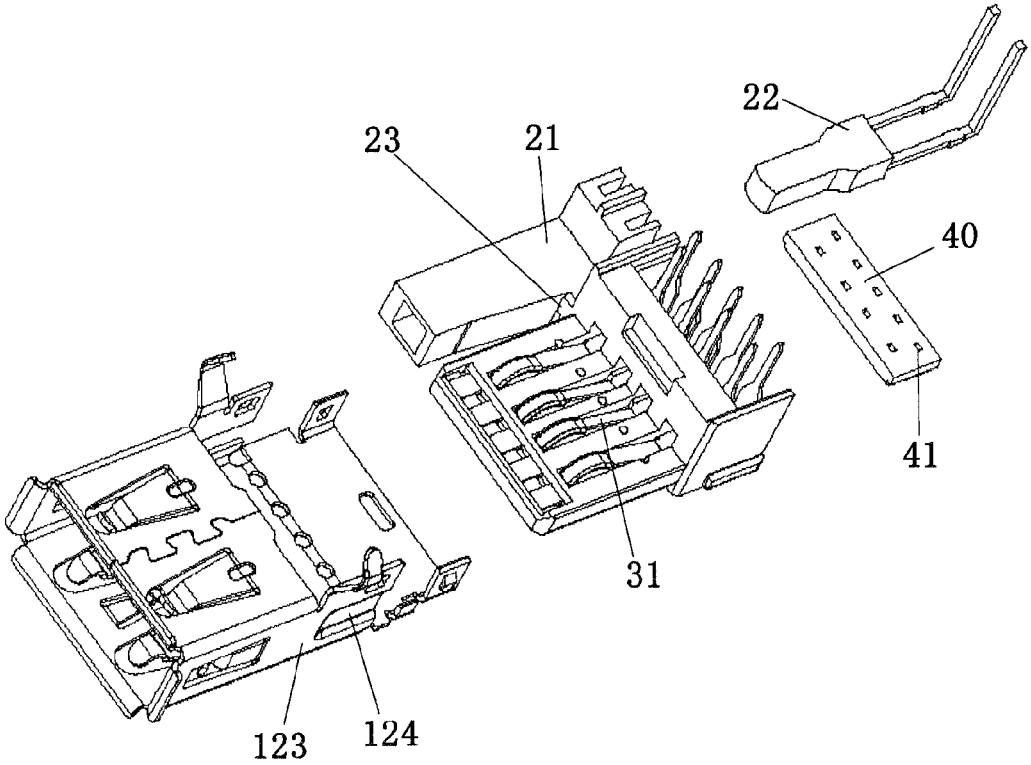
FIG. 5 in another exploded perspective view of the electrical connector assembly of FIG. 1.
Figure 6:
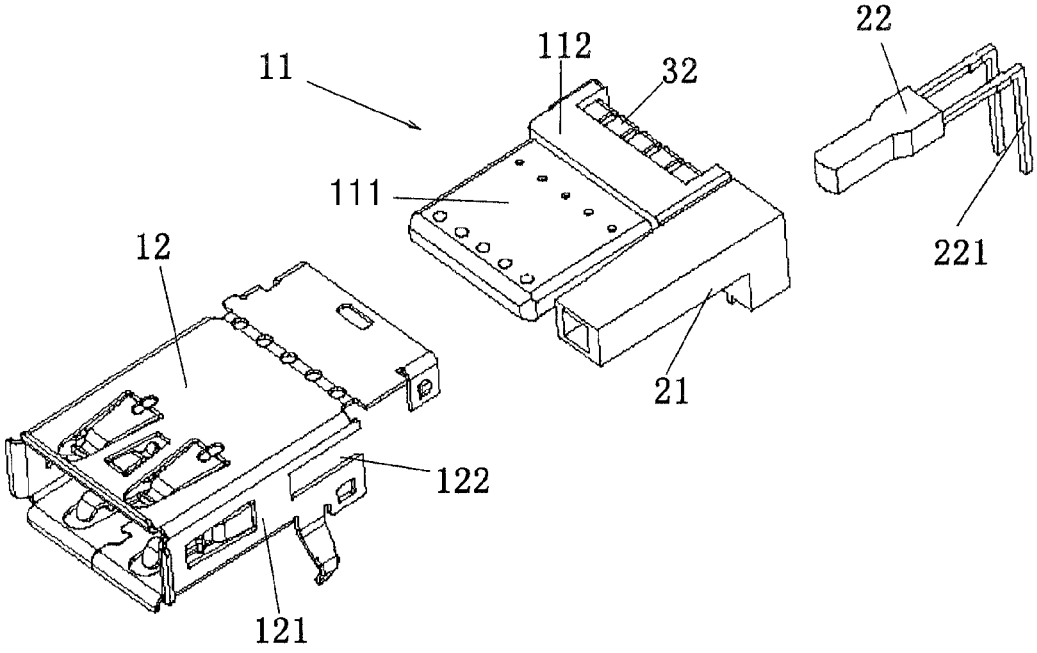
FIG. 6 in another exploded perspective view of the electrical connector assembly of in FIG. 1.
Figure 7:
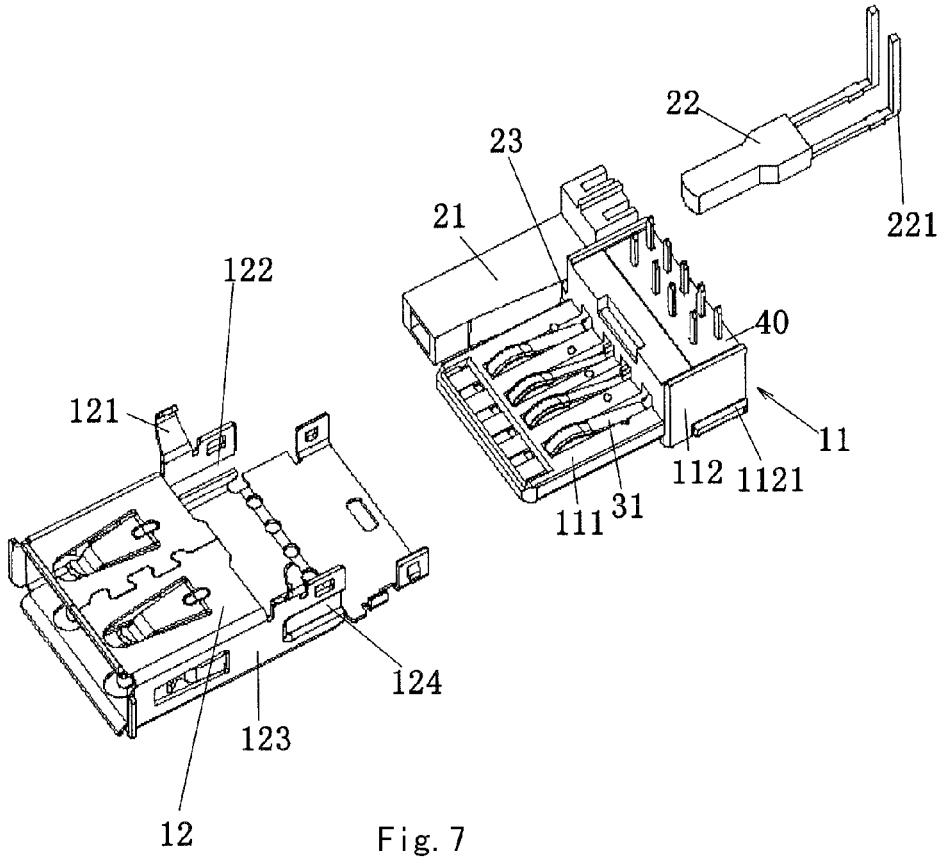
FIG. 7 in another exploded perspective view of the electrical connector assembly of FIG. 1.
Figure 8:
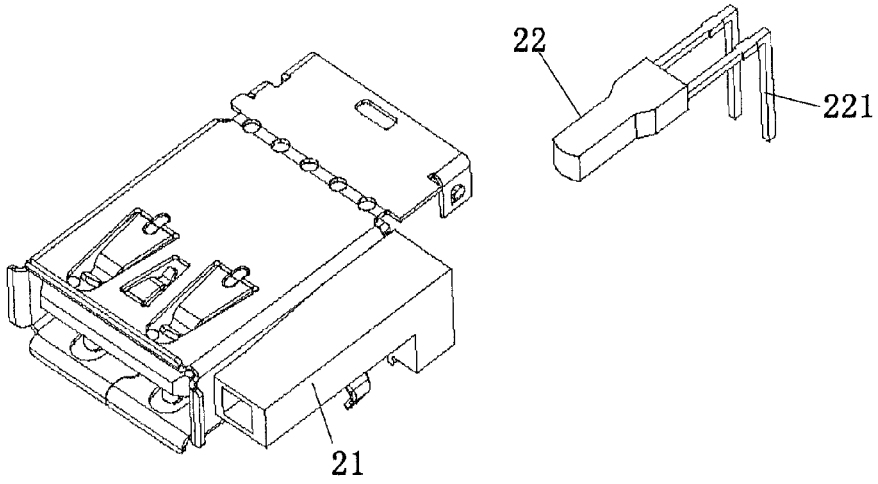
FIG. 8 in another exploded perspective view of the electrical connector assembly of FIG. 1.
Figure 9:
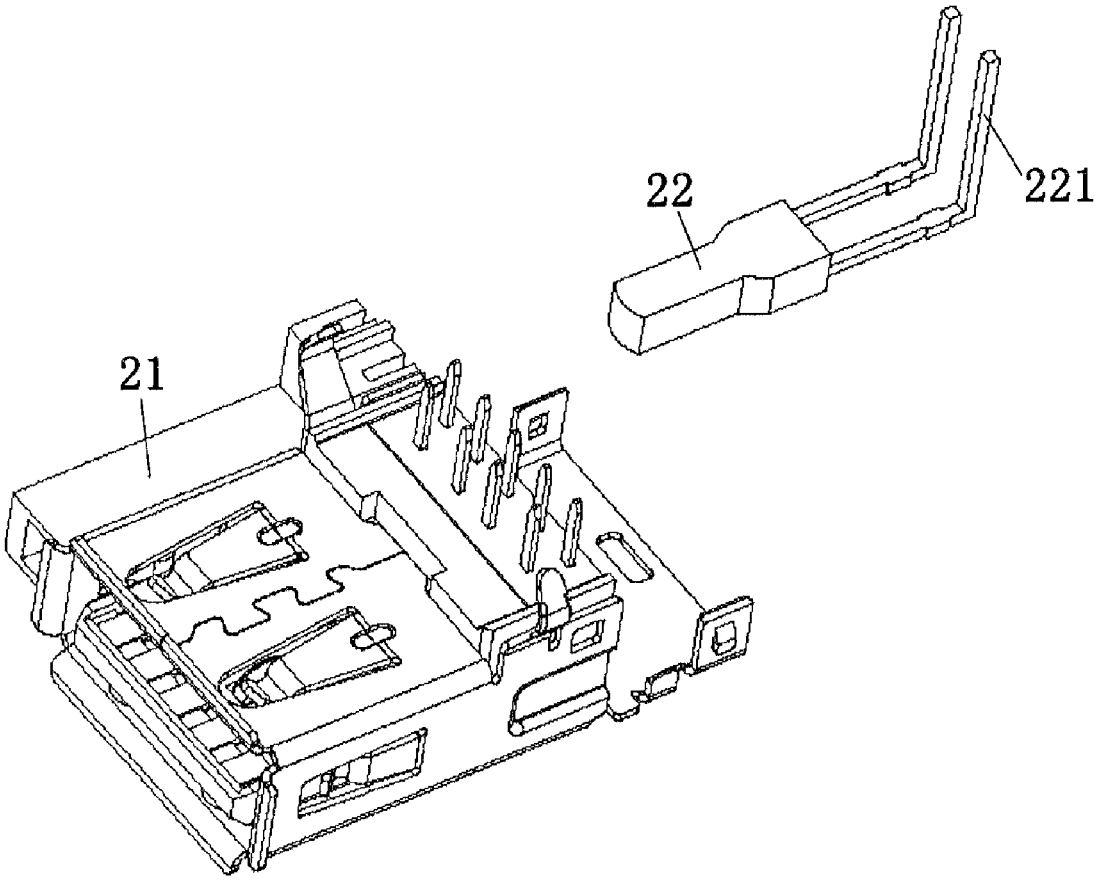
FIG. 9 in another exploded perspective view of the electrical connector assembly of FIG. 1.

Referring to FIGS. 3-7, the insulation body 11 includes a frame 112 configured to engage with the second housing 12 for receiving the insulation body 11 within the second housing 12, and a terminal block 111 supported on the frame 112 and substantially having a tongue shape. The terminal block 111 has a first surface (for example, the upper surface as shown in FIGS. 3, 4 and 6) and a second surface (for example, the lower surface as shown in FIGS. 3, 4 and 6, or the upper surface as shown in FIGS. 5 and 7) opposite to the first surface. The first connection portions 311 of the first conductive terminals 31 and the second connection portions 321 of the second conductive terminals 32 are positioned respectively along the second surface and the first surface of the terminal block 111 of the insulation body 11. Thus, the electrical connector according to the invention may be used as a socket electrical connector having both the USB2.0 interface and the USB3.0 interface, the socket electrical connector being adapted to engage with a plug electrical connector having a corresponding USB2.0 interface or a plug electrical connector having a corresponding USB3.0 interface, so that data may be communicated between the computer and different periphery apparatuses thereof.

In the exemplary embodiment of the present invention, the signal indicator 20 includes a first housing 21 and a luminous body 22 received therein, one side of the luminous body 22 is exposed from the first housing 21 so that the user may notice an operation state of the luminous body 22, for instance, whether the luminous body 22 is emitting light or not, and light of what color is emitted.

Referring to FIGS. 5 and 7, the insulation body 11 and the first housing 21 are formed integrally through a connection section 23 there between. Further, the first housing 21 has a substantially L-shape structure, an inner space running through the first housing 21 for receiving and exposing the luminous body 22. The first housing 21 and the insulation body 11 are arranged substantially in parallel with each other, and the insulation body 11 is connected to the first housing 21 at a side of the frame 112 through the connection section 23 so that the first housing 21 and the terminal block 111 are spaced from each other. It may be appreciated that the thickness of the connection section 23 may be smaller than those of the first housing 21 and the frame 112, as long as the first housing 21 and the frame 112 may be connected together by the connection section 23. Thus, though not shown, it can be appreciated that there is an elongate slot between the first housing 21 and the terminal block 111 and the bottom of the elongate slot is the connection section 23, when the first housing 21 and the insulation body 11 in FIGS. 6 and 7 are viewed from above or below.

As shown in FIGS. 3-7, the second housing 12 of the electrical connector 10 is defined by a plurality of side walls 121, 123. The terminal block 111 and the frame 112 of the insulation body 11 are received in the second housing 12, and the connection section 23 runs through a portion of a first side wall 121 of the plurality of side walls 121, 123 of the second housing 12 so that the first housing 21 is provided outside the second housing 12. Moreover, the first side wall 121 includes a body receiving side from which the insulation body 11 is inserted into the second housing 12. The first side wall 121 is provided with a first receiving slot 122 extending from the body receiving side, with the connection section 23 being adapted to be inserted into the first receiving slot 122 when the insulation body 11 is inserted into the second housing 12 from the body receiving side.

Further, a second side wall 123 opposite to the first side wall 121 of the second housing 12 is provided with a second receiving slot 124 opposite to the first receiving slot 122. Correspondingly, a protruding rib 1121 is integrally formed and positioned along a portion corresponding to second receiving slot 124 of the frame 112 of the insulation body 11. When the insulation body 11 is inserted into the second housing 12 from the body receiving side, the protruding rib 1121 is inserted into the slot 124 so that the insulation body 11 is stably held within the second housing 12 by the connection section 23 and the protruding rib 1121.

According to an embodiment of the present invention, the luminous body 22 includes a LED capable of emitting at least two kinds of light of different colors according to different driving signals from the electronic device. The LED includes two leads 221. Further, the electrical connector according to the invention also includes a terminal locator 40 made of insulation material, the terminal locator 40 includes a plurality of through holes 41 through which free ends of the first conductive terminals 31 and the second conductive terminals 32 run respectively so that the free ends are positioned respectively and insulated from each other. The free ends of the first conductive terminals 31, the free ends of the second conductive terminals 32 and the leads 221 of the LED are electrically connected to corresponding connection terminals of the electronic device.

The electrical connector 10 including both the USB2.0 interface and the USB3.0 interface have been described above in the embodiment. However, the present invention is not limited to this. It can be appreciated that the electrical connector 10 may include at least two of the USB2.0 interface, the USB3.0 interface and the eSATA interface. Further, in the case that the electrical connector 10 includes the USB2.0 interface, the USB3.0 interface and the eSATA interface, the conductive terminals of the USB2.0 interface and the conductive terminals of the USB3.0 interface are positioned along one surface of the terminal block 111 of the insulation body 11, and the conductive terminals of the eSATA interface are positioned along the other surface of the terminal block 111.

In addition, in the above embodiment of the present invention, the LED is used as the signal indicator 20. However, the present invention is not limited to this. For instance, the signal indicator 20 may be a signal indicator capable of displaying the operation states of the communication interfaces in characters or marks, specifically, a liquid crystal signal indicator, a nixie-tube signal indicator or the like may be used, and the housing thereof may be formed integrally with the housing of the electrical connector. In an alternative embodiment of the present invention, the signal indicator 20 may be positioned along the left side, the right side, the upper side or the lower side of the second housing 12 as desired.

In the electrical connector assembly according to the present invention, the socket electrical connector 10 includes the communication interfaces according with different communication standards and is capable of displaying the operation states of the communication interfaces, so that the user may keep abreast of which communication interface is in operation. For example, in the case that a LED is used as the luminous body of the signal indicator, the LED is controlled by a control circuit of the electronic device to emit light of different colors to indicate operational states of two signal transmission circuits. For example, if the LED emits light of one color, such as green, the signal indicator shows that one signal transmission circuit, such as the one for the USB2.0 interface, is in operation; if the LED emits light of another color, such as red, the signal indicator shows that the other signal transmission circuit, such as the one for the USB3.0 interface, is in operation; and if the LED does not emit light, the signal indicator shows that the two signal transmission circuits are not in operation. Therefore, the user may determine easily the operation states of the electrical connector 10 through visual observation. Hence, the operation states of the electrical connector 10 may be monitored without difficulty and the detection and maintenance of the electrical connector 10 is convenient. Further, since the housing of the signal indicator 20 and the insulation body 11 of the electrical connector 10 are integrally formed, it is easy to assemble the signal indicator 20 to the electrical connector 10 and further mount the whole electrical connector assembly to a mounting frame (for example, the housing) of the electronic device.

Although several embodiments have been shown and described, it would be appreciated by those skilled in the art that various changes or modifications may be made in these embodiments without departing from the principles and spirit of the disclosure, the scope of which is defined in the appended claims and their equivalents. In addition, please be noted that the word "a" or "an" does not exclude the meaning of "two" or "more", and the word "include" or "comprise" does not exclude other component or step.

What is claimed is:

1. An electrical connector assembly for an electronic device, comprising:

an electrical connector having at least two communication interfaces utilizing different communication standards; and a signal indicator secured along one side of the electrical connector;

wherein the signal indicator emits different colors of light corresponding to a function of one of the at least two communication interfaces.

2. The electrical connector assembly according to claim 1, wherein the at least two communication interfaces include at least two of a USB2.0 interface, a USB3.0interface and an eSATA interface.

3. The electrical connector assembly according to claim 2, wherein the USB2.0 interface includes first conductive terminals with a first connection portion.

4. The electrical connector assembly according to claim 3, wherein the USB3.0 interface has second conductive terminals with a second connection portion.

5. The electrical connector assembly according to claim 4, wherein the eSATA interface has third conductive terminals with a third connection portion.

6. The electrical connector assembly according to claim 5, wherein the electrical connector includes an insulative body.

7. The electrical connector assembly according to claim 6, wherein at least two of the first connection portion, the second connection portion and the third connection portion are positioned within the insulative body.

8. The electrical connector assembly according to claim 7, wherein the signal indicator includes a first housing and a luminous body received in the first housing.

9. The electrical connector assembly according to claim 8, wherein the insulative body and the first housing are integrally formed.

10. The electrical connector assembly according to claim 9, further comprising a second housing having a first side wall and a second side wall positioned opposite the first side wall.

11. The electrical connector assembly according to claim 10, wherein the second housing receives the insulative body.

12. The electrical connector assembly according to claim 11, wherein the insulation body and the first housing are integrally formed using a connection section positioned between the insulation body and the first housing.

13. The electrical connector assembly according to claim 12, wherein the connection section extends through the first side wall when the second housing receives the insulative body such that a portion of the first housing is positioned outside the second housing.

14. The electrical connector assembly according to claim 13, wherein the first side wall includes a first receiving slot extending from a body receiving side of the second housing.

15. The electrical connector assembly according to claim 14, wherein the first receiving slot receives the connection section.

16. The electrical connector assembly according to claim 10, wherein the insulative body includes a frame configured to engage with the second housing when the second housing receives the insulative body

17. The electrical connector assembly according to claim 16, wherein the insulative body further includes a terminal block supported on the frame and having a tongue shape.

18. The electrical connector assembly according to claim 10, wherein the second side wall includes a second receiving slot opposite to a first receiving slot extending from a body receiving side of the second housing.

19. The electrical connector assembly according to claim 18, wherein the insulative body includes a protruding rib corresponding with the second receiving slot when the insulative body is inserted into the second housing.

* * * * *